US007975865B2

(12) United States Patent
Marcel

(10) Patent No.: US 7,975,865 B2
(45) Date of Patent: Jul. 12, 2011

(54) CARGO BASKET

(76) Inventor: Eric P. Marcel, Mamou, LA (US)

( * ) Notice: Subject to any disclaimer, the term of this patent is extended or adjusted under 35 U.S.C. 154(b) by 456 days.

(21) Appl. No.: 12/114,760

(22) Filed: May 3, 2008

(65) Prior Publication Data

US 2009/0272738 A1 Nov. 5, 2009

(51) Int. Cl.
*B65D 88/02* (2006.01)
*B65D 88/12* (2006.01)

(52) U.S. Cl. ..... 220/1.5; 206/512; 220/612; 220/678

(58) Field of Classification Search ..... 220/1.5, 220/612, 678; 206/512; 217/5
See application file for complete search history.

(56) References Cited

U.S. PATENT DOCUMENTS 3,382,998 A * 5/1968 Turpen ..... 220/1.5
4,998,634 A * 3/1991 Nessfield ..... 220/1.5
5,052,569 A * 10/1991 Cooper ..... 220/1.5
5,661,930 A * 9/1997 Porter ..... 52/64
5,762,222 A * 6/1998 Liu ..... 220/1.5
5,950,373 A * 9/1999 von Hoff et al. ..... 52/79.5
6,170,689 B1 * 1/2001 Flesher et al. ..... 220/7
7,717,290 B2 * 5/2010 Gerding ..... 220/629
2004/0188433 A1 * 9/2004 Morales et al. ..... 220/1.5
2005/0194381 A1 * 9/2005 Zupancich et al. ..... 220/1.5
2008/0116199 A1 * 5/2008 Bublitz et al. ..... 220/1.5
2009/0126600 A1 * 5/2009 Zupancich et al. ..... 105/404
2009/0212047 A1 * 8/2009 Harman et al. ..... 220/1.5

* cited by examiner

*Primary Examiner* — Anthony Stashick
*Assistant Examiner* — Niki M Eloshway

(57) ABSTRACT

Embodiments provide a cargo basket including a frame, the frame including a base, the base including a pair of elongated first and second lower side members, the base including a pair of elongated first and second lower end members, the frame including a floor supported by the base, the frame including four corner posts extending from the base at respective of the four base corners, the frame including an elongated primary side wall supported by the base, the frame including a spaced pair of first and second end walls supported by the base, the frame including a spaced pair of first and second terminal side walls supported by the base, an access portal defined between the pair of terminal side posts, and a pair of gates supported for pivotal movement relative to respective of the terminal side posts.

10 Claims, 3 Drawing Sheets

CARGO BASKET

FIELD OF INVENTION

The disclosure relates to cargo baskets.

BACKGROUND OF INVENTION

Cargo baskets are used to transport cargo to facilities such as offshore oil exploration rigs. Cargo is grouped and loaded into the cargo baskets at a suitable location, such as a loading dock at a port facility. The loaded cargo baskets are transported by a suitable mode of transportation such as, for example, an ocean-going supply boat. The cargo baskets are transferred to a recipient, such as an offshore oil rig, in a suitable manner. For example, cargo baskets can be hoisted from a supply boat onto a receiving platform of an offshore oil rig by a single point hoist. The hoist is connected to raise each loaded cargo basket in a suitable manner, such as by a set of wire rope slings extending from a hoist hook to lifting eyes on the cargo basket.

Cargo baskets can be used to transport a variety of cargo. For example, a cargo basket can be used to transport large drilling tool components. The drilling tool components are loaded into the cargo basket in a suitable manner, such as by hand over a side of the cargo basket, or by hoist. A cargo basket can also be used to transport palletized cargo loads. In the specific context of offshore petroleum exploration, for example, the palletized cargo loads can be palletized containers of drilling supplies. Each palletized cargo load is connected to a suitable hoist, such as a single point hoist having a hook, with the use of hoist rigging such as flexible wire rope slings connected from the hoist hook and around the pallet, raised from the dock, positioned over the empty cargo basket, lowered into the cargo basket, and then the wire rope slings are removed for use with another load.

For reasons stated above, and for other reasons stated below which will become apparent to those skilled in the art upon reading and understanding the present specification, there is a need in the art for improved cargo baskets.

BRIEF DESCRIPTION OF INVENTION

The disclosure provides improved cargo baskets. Various shortcomings, disadvantages and problems of cargo baskets are addressed herein, which will be understood by reading and studying the following specification.

DETAILED DESCRIPTION OF EMBODIMENTS

In the following detailed description, reference is made to the accompanying drawings that form a part hereof, and in which is shown by way of illustration specific embodiments which can be practiced. The embodiments are described in sufficient detail to enable those skilled in the art to practice the embodiments, and it is to be understood that other embodiments can be utilized and that logical, mechanical and other changes can be made without departing from the scope of the embodiments. The following detailed description is, therefore, not to be taken in a limiting sense.

Figure 1:
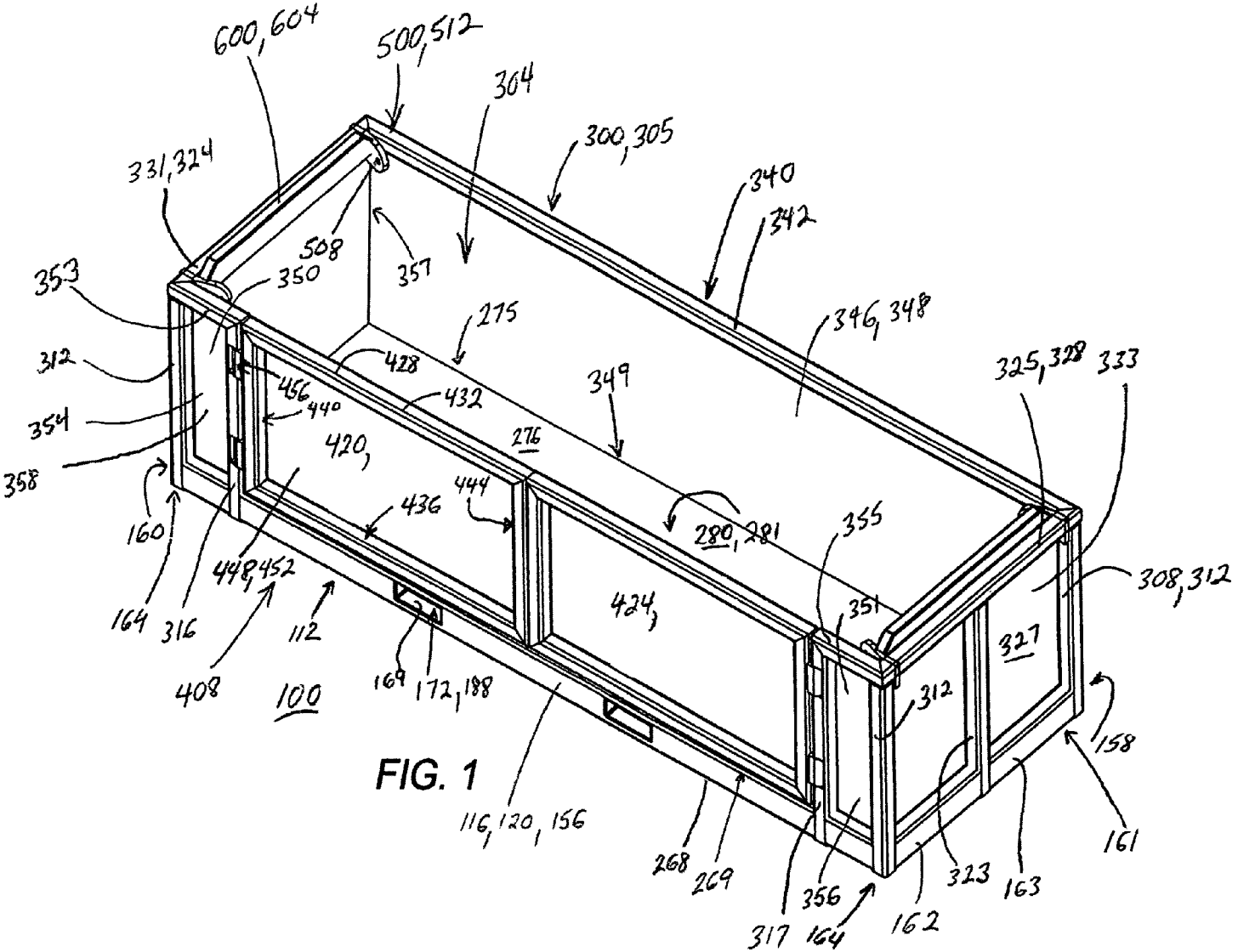
FIG. 1 is an elevated front perspective view of a cargo basket according to an embodiment.

FIG. 1 is an elevated front perspective view of a cargo basket 100 according to an embodiment. One skilled in the art will appreciate that cargo basket 100 can be configured differently without departing from the scope of the present disclosure and embodiments. Cargo basket 100 includes frame 112. Cargo basket 100 including frame 112 is adapted to receive, confine, and support (collectively and generally referenced hereinafter by the term hereinafter "support") a cargo load (not shown) which is to be moved, transferred or transported (collectively and generally referenced hereinafter by the term "transported"). It will be understood by those skilled in the art that cargo basket 100 including frame 112 can support any of a variety of suitable cargo loads (not shown) to be transported. For example, cargo basket 100 including frame 112 can support a plurality of loose or mixed items of suitable cargo. One specific example of such mixed items of suitable cargo is drilling tool components. It will be understood that cargo basket 100 including frame 112 can support one or a plurality of palletized cargo loads (not shown) having dimensions suitable to fit in frame 112. One specific example of such a palletized cargo load is palletized drilling tool components. It will be understood that cargo basket 100 including frame 112 can support any suitable cargo loads.

One skilled in the art will appreciate that frame 112 can be of any suitable dimensions. One skilled in the art will appreciate that frame 112 can be constructed of any suitable material. In the embodiment illustrated in FIG. 1, frame 112 is constructed of carbon steel. One skilled in the art will appreciate that frame 112 is only one specific configuration according to an embodiment. It will be understood that a cargo basket can include a frame having a different configuration without departing from the scope of embodiments, both those embodiments herein illustrated and other embodiments not specifically illustrated. It will be appreciated that cargo basket 100 including frame 112 is constructed according to at least one accepted or recognized structural engineering standard. In the specific embodiment illustrated in FIG. 1, cargo basket 100 including frame 112 is constructed in accordance with accepted structural design standards required for DNV Certification of Offshore Containers. More particularly, in the specific embodiment illustrated in FIG. 1, cargo basket 100 including frame 112 is designed and constructed in accordance with DNV Certification Notes No. 2.7-1 for Offshore Containers such as, for example, a version of DNV 2.7-1 of May 1995. It will be understood that cargo baskets according to embodiments (not shown) can comply with any other desired or suitable design standards. It will be understood that cargo basket 100 including frame 112 includes a plurality of weld seams (not shown) which comply with an accepted structural standard for welds. In the specific embodiment illustrated in FIG. 1, weld seams (not shown) comply with standard ANSI/AWS D1.1. It will be understood that cargo baskets according to embodiments (not shown) can include weld seams which comply with any other desired or suitable structural standard.

Figure 2:
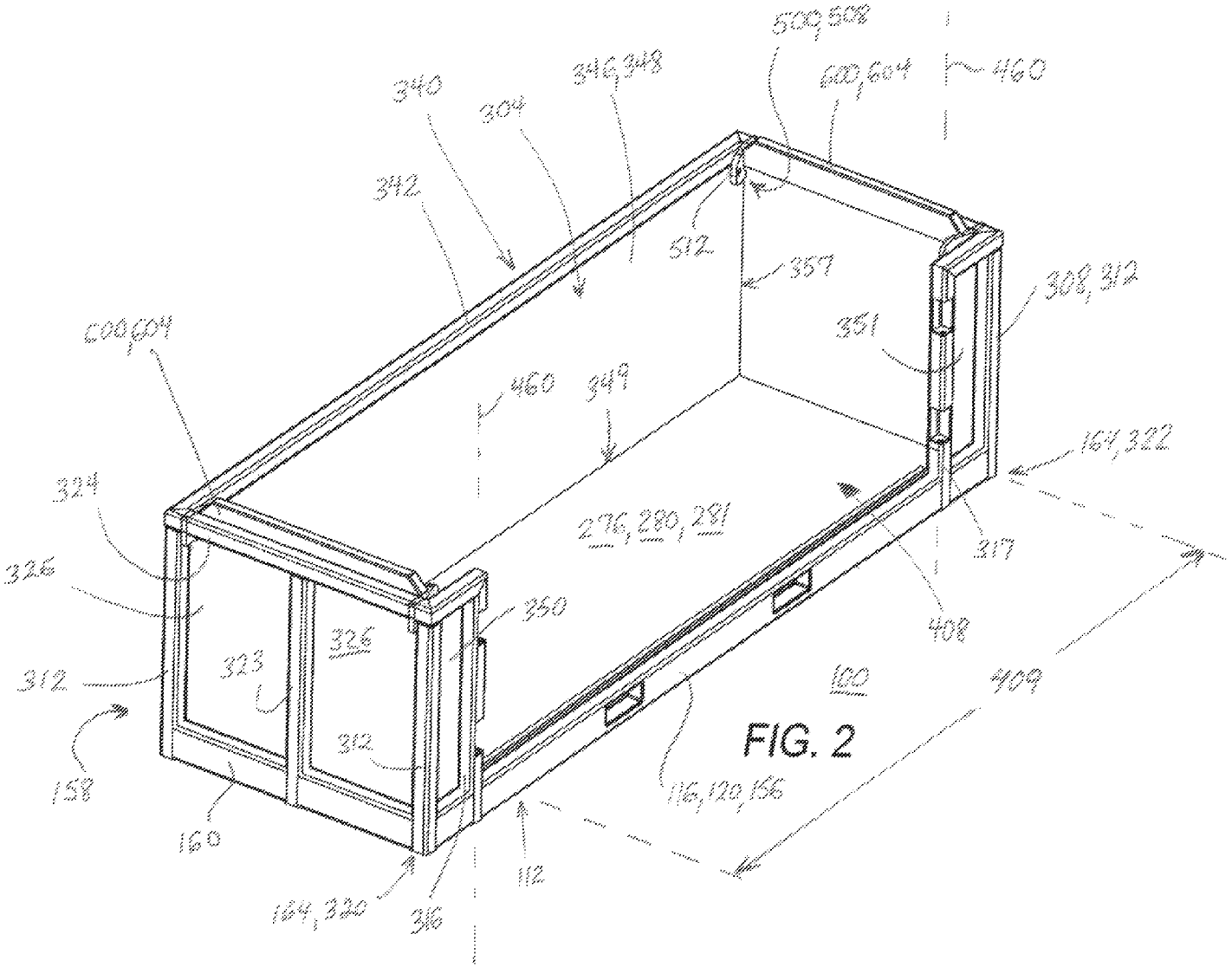
FIG. 2 is a front perspective view of a cargo basket shown in FIG. 1 with gates omitted for clarity.
Figure 3:
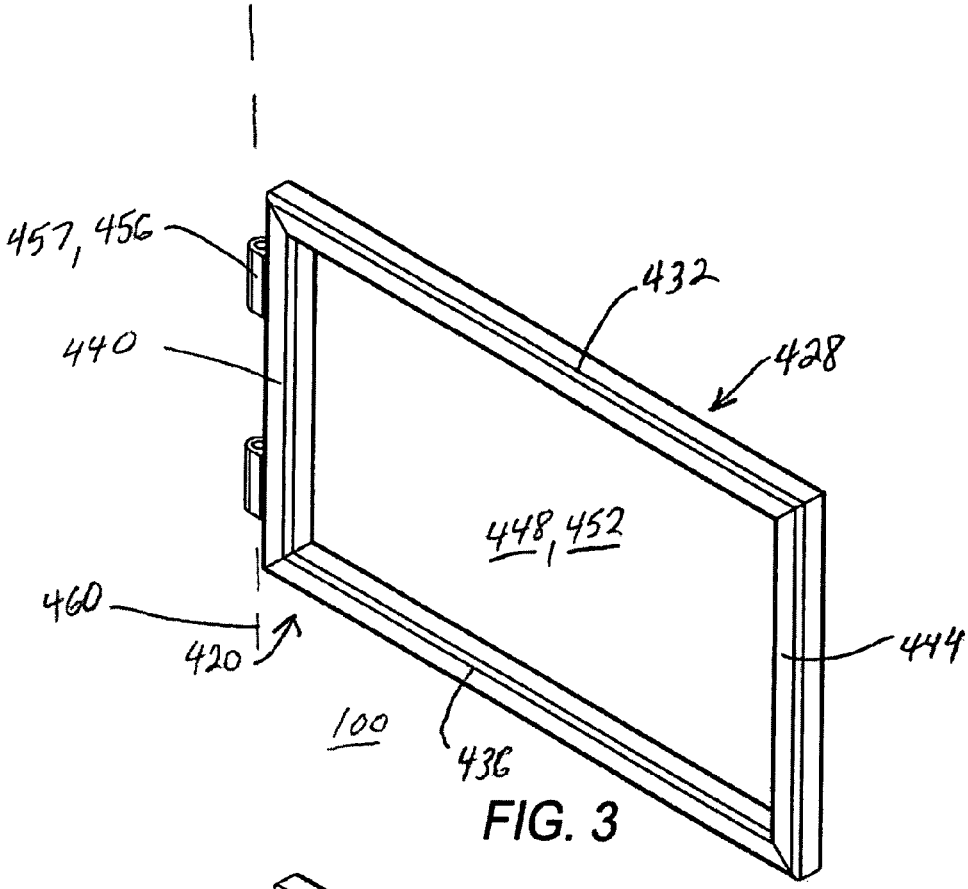
FIG. 3 is a front perspective isolation view of a first gate of a cargo basket shown generally in FIG. 1.
Figure 4:
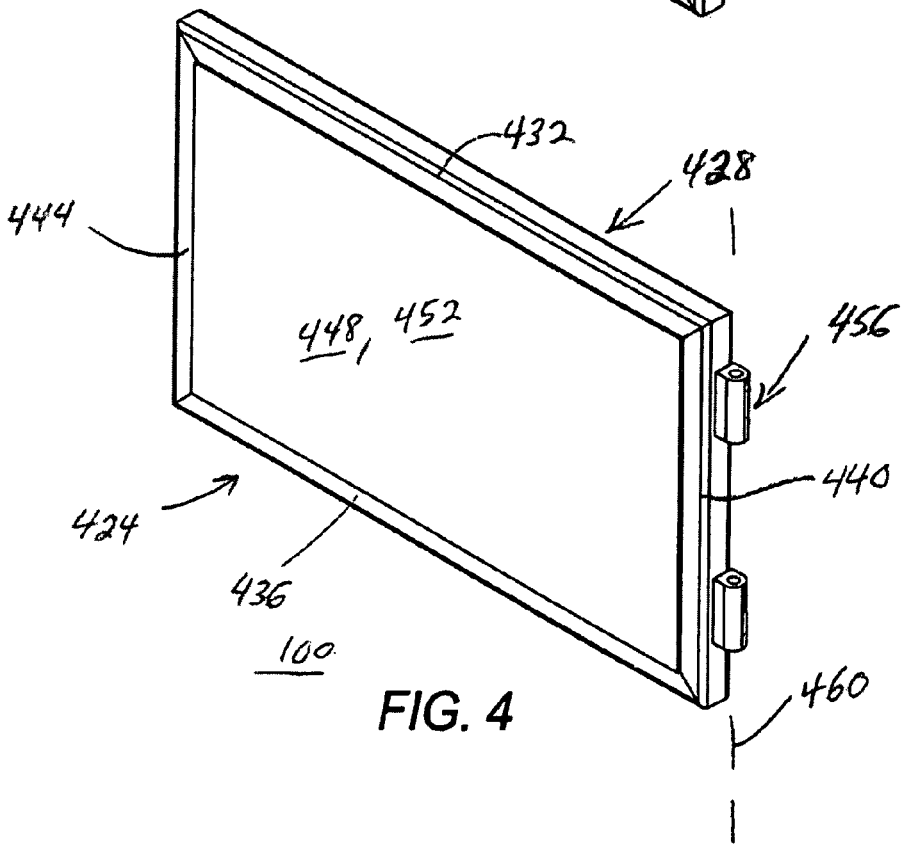
FIG. 4 is a front perspective isolation view of a second gate of a cargo basket shown generally in FIG. 1.

Frame 112 includes base 116. Base 116 includes a plurality of intersecting base members 120 defining a base frame 124. Base members 120 include a pair of elongated first and second first and second lower side members 156,158 extending in spaced, parallel relationship. It will be understood that second lower side member 158 (not shown) is identical to first lower side member 156. Base members 120 include a spaced pair of elongated first and second first and second lower end members 160,162 extending perpendicular to first and second lower side members 156,158. It will be understood that first lower end member 160 (FIG. 2) is identical to second lower end member 162. The first and second lower end members 160,162 intersect and are joined in fixed relation to the pair of first and second lower side members 156,158 at base corners 164. The first and second lower end members 160,162 and first and second lower side members 156,158 are joined in a suitable manner such as, in the specific embodiment illustrated, by respective weld seams. Cooperation of the first and second lower side members 156,158 and first and second lower end members 160,162 thus defines a generally rectangular periphery 161 of base 116. One skilled in the art will appreciate that first and second lower side members 156,158 and first and second lower end members 160,162 can be formed of any suitable material. In the embodiment shown in FIG. 1, first and second lower side members 156,158 and first and second lower end members 160,162 are formed of carbon steel tubing 163 having a rectangular tubular cross-section. In the specific embodiment illustrated in FIG. 1, first and second lower side members 156,158 and first and second lower end members 160,162 are formed of carbon steel tubing 163 having a rectangular cross-section with nominal dimensions of 6 inches by 4 inches. In the specific embodiment illustrated in FIG. 1, carbon steel tubing 163 complies with ASTM A-500 Gr.C. (R.O.P.S.) and has a nominal wall thickness of 0.25 inches. Base members 120 include a plurality of suitable brace members (not shown). A brace member is located inside the periphery 163 of base 116 at each corner 164 and extends between a respective one of the first and second lower end members 160,162 and a respective intersecting one of the first and second lower side members 156,158. It will be appreciated that, according to embodiments, base members 120 can include any suitable combination of brace members and intermediate members. Base members 120 include a pair of intermediate members 169. Each of the intermediate members 169 extends between the first and second lower side members 156,158 in spaced, parallel relation to the first and second lower end members 160,162. The term "intermediate members" includes any base member extending between the first and second lower side members 156,158 intermediate the first and second first and second lower end members 160,162. The term "intermediate members" also includes any base member extending between the first and second lower end members 160,162 intermediate the first and second first and second lower side members 156,158. Base members 120 can include brace members other than those specifically described herein. The term "brace member" includes, in addition to the brace members previously described herein, any other base member 120 which is not one of the first and second lower side members 156,158 or one of the first and second lower end members 160,162, and is not an intermediate member as herein described.

Each of the first and second lower side members 156,158 has therein a pair of spaced fork slots 172. Each of the fork slots 172 is dimensioned to receive a respective tine (not shown) of a forklift (not shown) for lifting base 116. Each fork slot 172 is defined by a respective one of the intermediate members 169. Each intermediate member 169 is an elongated tubular member which defines a fork tube 188. Each fork tube 188 extends between the first and second lower side members 165,158 in perpendicular relationship thereto. Opposite ends of each fork tube 188 are joined in a suitable manner to respective of the first and second lower side members 156, 158. In the illustrated embodiment, each fork tube 188 is integrally joined in fixed relation to respective side member 156 at fork slot 172 by respective weld seams. One skilled in the art will appreciate that fork tubes 188 can be formed of any suitable material. In the embodiment shown in FIG. 1, fork tubes 188 are carbon steel members having a rectangular tubular cross-section. In the specific embodiment illustrated in FIG. 1, fork tubes 188 are formed of tubing having a rectangular cross-section, with dimensions of 10 inches by 4 inches, and a material thickness of 0.25 inches, in accordance with ASTM A-500 Gr.C. (R.O.P.S.).

It will be understood that base 116 has a bottom surface 268 suitable to rest on a generally horizontal support surface (not shown). Examples of support surfaces can include, for example, a floor, deck, rack or the ground. In the specific embodiment illustrated in FIG. 1, bottom surface 268 is defined by cooperation of respective bottom surfaces of intersecting base members 120. In the specific embodiment illustrated in FIG. 1, the intersecting base members 120 include a generally horizontal upper surface 269 opposite from bottom surface 268.

Frame 112 includes floor 276 suitable to support cargo. In the specific embodiment illustrated in FIG. 1, floor 276 is formed of suitable continuous sheet material 280. Sheet material 280 is supported in a substantially rigid, fixed position by cooperation of base members 120 of base 116. More particularly, in the specific embodiment illustrated in FIG. 1, sheet material 280 is supported by upper surface 269 of intersecting base members 120. It will be understood that sheet material 280 defining floor 276 is joined to base members 120 in a suitable manner. In the specific embodiment illustrated in FIG. 1, sheet material 280 is defined by carbon steel plate 281 which is joined by a plurality of stitch welds to base members 120. In the specific embodiment illustrated, carbon steel plate 281 has a nominal thickness of 0.25 inches. It will be understood that in embodiments (not shown), floor 276 is an interrupted open lattice structure or has another suitable structure.

Frame 112 includes a plurality of sides 300. The plurality of sides 300 cooperates with base 116 to define an enclosure 304 about the periphery 275 of floor 276 and about a cargo load (not shown) resting on floor 276. The plurality of sides 300 are supported in relation to base 116 in a suitable manner. In one configuration, the sides 300 extend up in a vertical direction from the periphery 161 of base 116. In the specific embodiment illustrated in FIG. 1, the plurality of sides 300 defines a generally rectangular periphery 305 of enclosure 304. Cooperation of the sides 300 and base 116 prevents the cargo load from falling or sliding off floor 276. Sides 300 prevent or reduce potentially damaging contact between cargo and external structural features (not shown). External structural features can include, for example, movable structure such as cargo, or lifting apparatus such as a forklift, which can be encountered when the movable structure is moved relative to cargo basket 100. External structural features can also include, for example, fixed structure such as beams, rails or walls, which can be encountered when cargo basket 100 is moved.

The plurality of sides 300 of frame 112 includes a plurality of side posts 308 extending in the vertical direction. In the illustrated embodiment, the plurality of side posts 308 includes four (4) corner posts 312. Each corner post 312 extends upward in a vertical direction from base 116 at a respective one of the base corners 164. The corner posts 312 are integrally joined in fixed relationship with base 116 in a suitable manner, such as by weld seams (not shown). In the illustrated embodiment, the plurality of side posts 308 includes a pair of first and second terminal side posts 316,317. Each of the first and second terminal side posts 316,317 extends upward in a vertical direction from base 116 at a respective intermediate point of first side member 156. In the specific embodiment illustrated in FIG. 1, the first terminal side post 316 extends upward in a vertical direction from base 116 at a first intermediate point spaced along the first side member 156 from a respective first one 320 of the base corners 164. In the specific embodiment illustrated in FIG. 1, the second terminal side post 317 extends upward in a vertical direction from base 116 at a second intermediate point spaced along the first side member 156 from a respective second one 322 of the base corners 164. In the illustrated embodiment, the plurality of side posts 308 includes five (5) intermediate posts 323. Each intermediate post 323 extends upward in a vertical direction from base 116 at a respective intermediate point intermediate a respective pair of the corner posts 312 at base corners 164. The intermediate posts 323 are integrally joined in fixed relationship with base 116 in a suitable manner, such as by weld seams (not shown).

The sides 300 of frame 112 includes a pair of first and second end wall assemblies 331,333. First end wall assembly 331 includes first upper end member 324, a respective pair of corner posts 312, a respective intermediate post 323, and a first end wall panel 326. Second end wall assembly 333 includes second upper end member 325, a respective pair of corner posts 312, a respective intermediate post 323, and a second end wall panel 326. Each of the pair of first and second upper end members 324,325 extends between a respective pair of corner posts 312 and in spaced parallel relation to respective first and second lower end members 160,162. It will be appreciated that opposite ends of the first and second upper end members 324,325 are each joined to a respective corner post 312 in a suitable manner, such as by weld seams. An intermediate post 323 is joined to each of the first and second upper end members 324,325 at a respective midpoint intermediate the respective pair of corner posts 312. A first end wall panel 326 extends between the first upper end member 324, the respective adjoining pair of corner posts 312, and the first lower end member 160. A second end wall panel 327 extends between the second upper end member 325, the respective adjoining pair of corner posts 312, and the second lower end member 162. Each of the first and second end wall panels 326,327 is formed of suitable continuous plate material 328. In the specific embodiment illustrated in FIG. 1, plate material 328 is carbon steel having a nominal thickness of 0.25 inches. It will be appreciated that each of the first and second end wall panels 326,327 are each joined to adjoining members and floor 276 in a suitable manner, such as by respective continuous weld seams.

The sides 300 of frame 112 includes a primary side wall assembly 340. Primary side wall assembly 340 includes a primary upper side member 342, a respective adjoining pair of corner posts 312, a respective set of intermediate posts (not shown), and a primary side wall panel 344. The primary upper side member 342 extends between a respective pair of corner posts 312 and in spaced parallel relation to respective second lower side member 158 (not shown). It will be appreciated that opposite ends of the primary upper side member 342 are each joined to a respective corner post 312 in a suitable manner, such as by weld seams. Three of the intermediate posts 323 are joined to the primary upper side member 342 at intermediate points spaced at generally equal intervals between the respective pair of corner posts 312. A primary side wall panel 346 extends between the primary upper side member 342, the respective adjoining pair of corner posts 312, and the first lower side member 158. The primary side wall panel 346 is formed of suitable continuous plate material 348. In the specific embodiment illustrated in FIG. 1, plate material 348 is carbon steel having a nominal thickness of 0.25 inches. It will be appreciated that the primary side wall panel 346 is joined to adjoining members and floor 276 along a generally horizontal wall-floor joint 349 in a suitable manner, such as by respective continuous weld seams.

The sides 300 of frame 112 includes a pair of first and second terminal side wall assemblies 350,351. First terminal side wall assembly 350 includes a first terminal upper side member 353, a respective adjoining corner post 312, a respective adjoining first terminal side post 316, and a first terminal side wall panel 354. Second terminal side wall assembly 351 includes a second terminal upper side member 355, a respective adjoining corner post 312, a respective adjoining second terminal side post 317, and a second terminal side wall panel 356. Each of the first and second terminal upper side members 353,355 extends between a respective corner post 312 and a respective one of the first and second terminal side posts 316,317 in spaced parallel relation to respective first lower side member 156. It will be appreciated that opposite ends of the first and second terminal upper side member 353,355 are each joined to respective corner post 312 and respective of the first and second terminal side posts 316,317 in a suitable manner, such as by weld seams. Each of the first and second terminal side wall panels 354,356 extends between the respective one of the first and second terminal upper side members 353,355, the respective adjoining corner post 312, the respective adjoining one of the first and second terminal side posts 316,317, and the first lower side member 156. Each of the first and second terminal side wall panels 354,356 is formed of suitable continuous plate material 358. In the specific embodiment illustrated in FIG. 1, plate material 358 is carbon steel having a nominal thickness of 0.25 inches. It will be appreciated that each of the first and second terminal side wall panels 354,356 are each joined to adjoining members and floor 276 in a suitable manner, such as by respective continuous weld seams.

In the specific embodiment illustrated in FIG. 1, first and second end wall panels 326,327, primary side wall panel 346, and first and second terminal side wall panels 354,356 are joined at respective vertical interior corners 357 in a suitable manner, such as by continuous weld seams. It will also be appreciated that first and second end wall panels 326,327, primary side wall panel 346, and first and second terminal side wall panels 354,356 are joined with floor 276 at respective horizontal floor seams 349 in a suitable manner, such as by continuous weld seams. It will be understood that in embodiments (not shown), any of the preceding are joined in another suitable manner such as, for example, by a plurality of suitable threaded bolt and nut fastener combinations.

An elongated front access portal 408 (FIG. 2) is defined along a major portion 409 extending above the first lower side member 156 and extends between first terminal side post 316 and second terminal side post 317. It will be appreciated that front access portal 408 is spaced from primary side wall assembly 340 in parallel relation thereto. Front access portal 408 defines an opening for cargo to be moved to and from floor 276 of interior 304 above base 116. More particularly, front access portal 408 defines between first terminal side post 316 and second terminal side post 317 a respective major opening through which cargo can be moved to and from floor 276 of interior 412 at a relatively low height above base 116 at first lower side member 156. It will be understood that personnel can step through front access portal 408 to carry cargo to and from floor 276 of interior 304. Similarly, it will be understood that personnel can operate a forklift to move palletized cargo through front access portal 408 to and from floor 276 of interior 304. It will be understood that the length of major portion 409 of access portal 408 exceeds more than the combined lengths of first and second terminal side walls 350,351.

The sides 300 of frame 112 include a pair of first and second front gates 420,424. First and second front gates 420, 424 are supported to close and open front access portal 408. It will be appreciated that first and second front gates 420,424 are substantially identical, except as otherwise described herein. Each of the first and second front gates 420,424 is a defined by a respective gate panel assembly 428. Gate panel assembly 428 includes a pair of upper and lower horizontal gate members 432,436 and an intersecting pair of first and second vertical gate members 440,444. Gate panel assembly 428 includes a gate panel 448 which extends between the pair of upper and lower horizontal gate members 432,436 and the pair of first and second vertical gate members 440,444. It will be appreciated that gate panel 448 is formed of suitable rigid sheet material 452. In the specific embodiment illustrated in FIG. 1, rigid sheet material 452 is carbon steel plate having a nominal thickness of 0.25 inches. Each gate panel assembly 428 includes and are supported by a set of gate hinges 456. Gate hinges 456 can be of any suitable construction. One skilled in the art will appreciate that hinges 456 can be oriented in any direction. In the specific embodiment illustrated in FIG. 1, each gate hinge 456 includes a hinge arm 457 mounted for selective pivotal movement about a vertical pivot axis 460 defined by a suitable pivot pin (not shown). It will be appreciated that each of the first and second terminal side posts 316,317 has therein respective recesses 464 to accommodate each hinge arm 457. It will be understood that pivot axis 460 is inboard and does not protrude outside frame 112 beyond the respective first or second terminal side post 316, 317. It will further be appreciated that each of the first and second front gates 420,424 includes a suitable latch (not shown). The latches (not shown) can be of any suitable construction. In one specific embodiment (not shown), each latch includes a handle actuated cam and rod assembly of the type used to secure freight container door panels. It will be understood that any other suitable latch can be used. The respective latches are selectively operable to secure the respective first and second front gates 420,424 in a closed position (shown in FIG. 1). Each latch is selectively operable to permit the respective first and second front gates 420,424 to be pivoted open about a respective pivot axis 460 relative to respective of the first terminal side post 316 and second terminal side post 317. It will be appreciated that first and second front gates 420,424 meet in proximity at a midpoint when in the closed position.

Frame 112 includes hoist engagement structure 500. One skilled in the art will appreciate that, in embodiments, hoist engagement structure 500 can include any structure suitable to be engaged by a hoist (not shown) for hoisting cargo basket 100. In the specific embodiment illustrated in FIG. 1, hoist engagement structure 500 includes a plurality of lifting eyes 508. Each lifting eye 508 defines a respective opening suitable to receive a shackle (not shown) attached to a respective wire rope sling (not shown) of flexible hoist rigging (not shown). Each lifting eye 508 is formed in a respective support member or lifting ear 512. Each lifting ear 512 is integrally joined to frame 112 in a manner sufficient to bear a load when a hoist is operated to raise and move frame 112. In the illustrated embodiment, each lifting ear 512 is integrally joined to a respective one of the corner posts 312 by suitable weld seams. It will be appreciated that hoist engagement structure 500 can be joined with other members of frame 112 in any manner suitable to bear a desired load when hoisted. The lifting eyes 508 are positioned inside frame 112, such that the lifting eyes 508 do not protrude above or outside frame 112 and thus do not interfere with other cargo baskets when stacked atop or positioned adjacent cargo basket 100. It will be understood that lifting eyes 508 can be provided in any suitable arrangement which permits cargo basket 100 to be hoisted when carrying a cargo load.

Cargo basket 100 includes a plurality of upper alignment guides 600. Upper alignment guides 600 align a second identical cargo basket (not shown) to be stacked atop frame 112. Upper alignment guides 600 can be of any suitable construction. In the embodiment illustrated in FIG. 1, upper alignment guides 600 include a pair of transverse alignment bars 604. Each transverse alignment bar 604 is fixed to the interior of a respective one of the first and second end wall assemblies 331,333. The pair of alignment bars 604 project above frame 112 inboard of the first and second end wall assemblies 331, 333. The alignment bars 604 are supported in a suitable manner such as, for example, by being joined by respective weld seams to the respective first and second end wall assemblies 331,333. The alignment bars 604 are configured to be received in a base 116 of an identical second cargo basket (not shown) stacked atop cargo basket 100. The alignment bars 604 when received in base 116 of a second cargo basket stacked atop frame 112 of cargo basket 100 keep or prevent the second cargo basket from sliding relative to cargo basket 100. It will be appreciated that alignment bars 604 can include one or more recesses, notches or cutouts (not shown) positioned to receive any brace members (not shown) in the base of second cargo basket.

In view of the foregoing, embodiments provide cargo baskets including a pair of first and second front gates 420,424 which are pivotable to selectively permit access to floor 276 of cargo basket interior 412 above base 116 through front access portal 408 for loading and unloading cargo. Each of the first and second front gates 420,424 is selectively pivotable about a respective vertical pivot axis 460 at a respective one of the first terminal side post 316 and second terminal side post 317. A forklift can load and unload suitable cargo through front access portal 408 when first and second front gates 420,424 are open. First and second front gates 420,424 can be secured in the closed position by operation of a latch mechanism. First and second front gates 420,424 in the closed position cooperate to close access portal 408 and interior 412.

It will be understood that embodiments provide cargo baskets having construction, elements and improvements which are well-suited for transport, transfer and storage of cargo in rugged, off-shore marine environments, such as off-shore oil platforms. More particularly, it will be understood that embodiments provide cargo baskets which can be transported and transferred via suitable hoist equipment from supply vessels to off-shore oil platforms, and vice-versa. Although specific embodiments are illustrated and described herein, it will be appreciated by those of ordinary skill in the art that any arrangement which is calculated to achieve the same purpose can be substituted for the specific embodiments shown. This application is intended to cover any adaptations or variations. For example, although described in terms of the specific embodiments, one of ordinary skill in the art will appreciate that implementations can be made in different embodiments to provide the required function. In particular, one of skill in the art will appreciate that the names and terminology of the apparatus are not intended to limit embodiments. Furthermore, additional apparatus can be added to the components, functions can be rearranged among the components, and new components to correspond to future enhancements and physical devices used in embodiments can be introduced without departing from the scope of embodiments. The terminology used in this application is intended to include all environments and alternatives which provide the same functionality as described herein.

I claim:

1. A cargo basket comprising:

a frame;

the frame including a base adapted to rest on a generally horizontal support surface, the base including a pair of elongated first and second lower side members, the base including a pair of elongated first and second lower end members, the pair of elongated first and second lower end members being joined in fixed perpendicular relation to the pair of elongated first and second lower side members at four base corners, the base defining a rectangle;

the frame including a floor supported by the base;

the frame including four corner posts extending from the base in the vertical direction at respective of the four base corners;

the frame including an elongated primary side wall supported by the base in integral fixed relation therewith, the primary side wall including a primary upper side wall member extending between a respective pair of the corner posts in perpendicular relation therewith, the primary upper side wall member having opposite ends each joined in fixed integral relation to respective of the corner posts, the primary side wall including a primary side wall panel, the primary side wall panel being joined in fixed relation with the primary upper side wall member, the primary side wall panel being joined in fixed relation with the pair of corner posts, the primary side wall panel along a horizontal lower edge thereof being joined in fixed relation with the floor;

the frame including a spaced pair of first and second end walls supported by the base in integral fixed relation therewith, each of the first and second end walls including a respective upper end wall member extending between a respective pair of the corner posts in perpendicular relation therewith, the upper end wall member having opposite ends each joined in fixed integral relation to respective of the corner posts, the first end wall including a first end wall panel, the second end wall including a second end wall panel, each of the first and second end wall panels being joined in fixed relation with a respective upper end wall member, each of the first and second end wall panels being joined in fixed relation with a respective pair of corner posts, the first and second end wall panels along a horizontal lower edge thereof being joined in fixed relation with the floor;

the frame including a spaced pair of first and second terminal side walls supported by the base in integral fixed relation therewith, each of the first and second terminal side walls including a respective upper terminal side wall member extending between a respective corner post and a generally vertical terminal side post, the terminal side posts being spaced along the first lower side member opposite the primary side wall, the first terminal side wall including a first terminal side wall panel, the second terminal side wall including a second terminal side wall panel, each of the first and second terminal side wall panels being joined in fixed relation with a respective upper terminal side wall member, each of the first and second terminal side wall panels being joined in fixed relation with a respective corner post, each of the first and second terminal side wall panels being joined in fixed relation with a respective terminal side post spaced from the respective corner post, the first and second terminal side wall panels along a horizontal lower edge thereof being joined in fixed relation with the floor;

the frame defining a cargo well above the floor, the frame having a continuous upper edge spaced above the floor, he continuous upper edge extending in substantially parallel relation to the floor, the cargo well extending from the floor to the continuous upper edge, the continuous upper edge defining an open top of the cargo well;

an access portal defined between the pair of terminal side posts, the access portal extending generally above a major portion of the first lower side member in parallel spaced relation to the primary side wall, the access portal having a length along the major portion exceeding the combined lengths of the pair of adjacent terminal side walls; and a pair of gates supported for pivotal movement relative to respective of the terminal side posts, the pair of gates in a closed position closing the access portal, the pair of gates in an open position permitting access for loading and unloading cargo through the access portal.

2. A cargo basket as set forth in claim 1 and further comprising:

a set of lifting eyes each defined in a respective lifting ear, the lifting ears being located in an interior space defined by the frame.

3. A cargo basket as set forth in claim 1 and further comprising:

a set of upper alignment guides supported by the frame in fixed relation therewith, the set of upper alignment guides being located to cooperate with a second cargo basket stacked on the frame, the set of upper alignment guides preventing the second cargo basket from sliding movement relative to the frame.

4. A cargo basket as set forth in claim 1 and further comprising:

the primary side wall, the pair of first and second end walls, and the first and second terminal side walls being joined by respective generally vertical weld seams at respective corner joints.

5. A cargo basket as set forth in claim 1 and further comprising:

the primary side wall, the pair of first and second end walls, and the first and second terminal side walls being joined with the floor by respective generally horizontal weld seams at respective joints with the floor.

6. A cargo basket as set forth in claim 1 and further comprising:

the base including a set of fork slots.

7. A cargo basket comprising:

a frame;

the frame including a base adapted to rest on a generally horizontal support surface, the base including a pair of elongated first and second lower side members, the base including a pair of elongated first and second lower end members, the pair of elongated first and second lower end members being joined in fixed perpendicular relation to the pair of elongated first and second lower side members at four base corners, the base defining a rectangle;

the frame including a floor supported by the base;

the frame including four corner posts extending from the base in the vertical direction at respective of the four base corners;

the frame including an elongated primary side wall supported by the base in integral fixed relation threrewith, the primary side wall including a primary upper side wall member extending between a respective pair of the corner posts in perpendicular relation therewith, the primary upper side wall member having opposite ends each joined in fixed integral relation to respective of the corner posts, the primary side wall including a primary side wall panel, the primary side wall panel being joined in fixed relation with the primary upper side wall member, the primary side wall panel being joined in fixed relation with the pair of corner posts, the primary side wall panel along a horizontal lower edge thereof being joined in fixed relation with the floor;

the frame including a spaced pair of first and second end walls supported by the base in integral fixed relation therewith, each of the first and second end walls including a respective upper end wall member extending between a respective pair of the corner posts in perpendicular relation therewith, the upper end wall member having opposite ends each joined in fixed integral relation to respective of the corner posts, the first end wall including a first end wall panel, the second end wall including a second end wall panel, each of the first and second end wall panels being joined in fixed relation with a respective upper end wall member, each of the first and second end wall panels being joined in fixed relation with a respective pair of corner posts, the first and second end wall panels along a horizontal lower edge thereof being joined in fixed relation with the floor;

the frame including a spaced pair of first and second terminal side walls supported by the base in integral fixed relation therewith, each of the first and second terminal side walls including a respective upper terminal side wall member extending between a respective corner post and a generally vertical terminal side post, the terminal side posts being spaced along the first lower side member opposite the primary side wall, the first terminal side wall including a first terminal side wall panel, the second terminal side wall including a second terminal side wall panel, each of the first and second terminal side wall panels being joined in fixed relation with a respective upper terminal side wall member, each of the first and second terminal side wall panels being joined in fixed relation with a respective corner post, each of the first and second terminal side wall panels being joined in fixed relation with a respective terminal side post spaced from the respective corner post, the first and second terminal side wall panels along a horizontal lower edge thereof being joined in fixed relation with the floor;

the frame defining a cargo well above the floor, the frame having a continuous upper edge spaced above the floor, the continuous upper edge extending in substantially parallel relation to the floor, the cargo well extending from the floor to the continuous upper edge, the continuous upper edge defining an open top of the cargo well;

an access portal defined between the pair of terminal side posts, the access portal extending generally above a major portion of the first lower side member in parallel spaced relation to the primary side wall, the access portal having a length along the major portion exceeding the combined lengths of the pair of adjacent terminal side walls;

a pair of gates supported for pivotal movement relative to respective of the terminal side posts, the pair of gates in a closed position closing the access portal, the pair of gates in an open position permitting access for loading and unloading cargo through the access portal;

a set of lifting eyes each defined in a respective lifting ear, the lifting ears being located in an interior space defined by the frame; and a set of upper alignment guides supported by the frame in fixed relation therewith, the set of upper alignment guides being located to cooperate with a second cargo basket stacked on the frame, the set of upper alignment guides preventing the second cargo basket from sliding movement relative to the frame.

8. A cargo basket as set forth in claim 7 and further comprising:

the primary side wall, the pair of first and second end walls, and the first and second terminal side walls being joined by respective generally vertical weld seams at respective corner joints.

9. A cargo basket as set forth in claim 7 and further comprising:

the primary side wall, the pair of first and second end walls, and the first and second terminal side walls being joined with the floor by respective generally horizontal weld seams at respective joints with the floor.

10. A cargo basket as set forth in claim 7 and further comprising:

the base including a set of fork slots.

* * * * *